United States Patent [19]

Kitterman

[11] 4,271,405

[45] Jun. 2, 1981

[54] ALARM CONTROL SYSTEM

[76] Inventor: Lawrence P. Kitterman, 7112 Joe Will, Grapevine, Tex. 76051

[21] Appl. No.: 866,377

[22] Filed: Jan. 3, 1978

[51] Int. Cl.[3] ..... G08B 13/12; G08B 29/00

[52] U.S. Cl. ..... 340/512; 340/506; 340/508; 340/527; 340/531; 340/533; 340/535; 340/541; 340/547; 340/548; 340/549; 340/309.1; 200/61.18; 335/207

[58] Field of Search ..... 340/500, 506, 508, 509, 340/512, 514, 521, 527, 526, 528, 529, 546, 541, 545, 547, 548, 549, 327, 309.1, 531, 533, 535; 200/61.93, 61.15, 61.16, 61.17, 61.18; 335/205, 207

[56] References Cited

U.S. PATENT DOCUMENTS

| | | | |
|---|---|---|---|
| 676,744 | 6/1901 | Gatten | 200/61.81 |
| 1,238,532 | 8/1917 | Lemberg | 200/61.93 |
| 2,208,721 | 7/1940 | Demosthenes | 200/162 |
| 2,228,120 | 1/1941 | Koehler | 200/161 |
| 2,643,313 | 6/1953 | Christie | 200/61.93 |
| 2,780,689 | 2/1957 | LaCavera | 200/61.93 |
| 2,922,150 | 1/1960 | Jezl | 200/61.64 |
| 3,233,060 | 2/1966 | Wintriss | 200/19 |
| 3,358,199 | 12/1967 | Jones | 200/61.17 |
| 3,452,345 | 6/1969 | Kinsey | 340/514 |
| 3,537,093 | 10/1970 | Perret | 340/545 |
| 3,540,043 | 11/1970 | Crosthwait | 340/527 |
| 3,603,973 | 9/1971 | Hough | 340/506 |
| 3,683,362 | 8/1972 | Schwanenflugel | 340/309.1 |
| 3,686,668 | 8/1972 | Durkee | 340/508 |
| 3,696,380 | 10/1972 | Murphy | 340/547 |
| 3,795,896 | 3/1974 | Isaacs | 340/547 |
| 3,938,121 | 2/1976 | Jamison | 340/539 |
| 4,001,805 | 1/1977 | Golbe | 340/527 |
| 4,032,909 | 6/1977 | Boyce | 340/514 |

*Primary Examiner*—John W. Caldwell, Sr.
*Assistant Examiner*—Donnie L. Crosland
*Attorney, Agent, or Firm*—Richards, Harris & Medlock

[57] ABSTRACT

In an alarm control system for protecting a premises, a four conductor bus line leading from a master control station is extended about the interior perimeter of the premises. Sensors positioned near each port of entry to be monitored are connected in parallel relationship to the bus line, as is at least one remote station for manually arming, disarming or activating the system. Each sensor comprises a biased reel carrying line secured to window, door, screen, or the like. Disturbance of a sensor causes a magnetically responsive switch therein to generate a pulse triggering circuitry within the control station to activate the desired alarm device for a predetermined period of time. The system then resets automatically to an armed or ready condition to continue protecting the premises against subsequent intrusions. Preferably, the lines in the sensors are of a thermoplastic material so that the system is also activated by abnormally high temperature in the event of fire. If desired, one or more key operated switches can be connected to the bus line to arm or disarm the system from the exterior of the premises.

26 Claims, 8 Drawing Figures

ALARM CONTROL SYSTEM

BACKGROUND AND SUMMARY OF THE INVENTION

The present invention relates generally to an improved alarm control system for actuating an alarm device in response to a warning signal. More particularly, the invention is directed to an alarm control system which automatically resets after each activation to continue sensing subsequent alarm conditions on the premises.

The problem of protecting a premises, and especially premises which are situated in a remote location or periodically unoccupied, against unauthorized intrusions has been one of continuing importance. Various approaches have been taken to this difficult problem, and the prior art contains numerous examples of alarm or warning devices. The earliest forms of such alarm devices were basically of a mechanical nature, such as a trip wire connected between a bell and a door, window, or the like. Relatively crude, these devices have limited capability and require manual resetting after actuation. More recently, sophisticated electronic devices including lamp/photosensors or ultrasonic sources have become popular. These complicated devices, though not necessarily of broader capabilities, are generally expensive to purchase and difficult to install. Some of these prior art devices do not detect an intruder until he is inside the building being monitored. Moreover, many of these electronic alarm devices do not provide for automatic resetting of the device after activation and without manual intervention. Heretofore there has not been available an alarm control system of rugged and inexpensive construction; which can be easily installed by the average owner or occupant; which automatically resets after each activation to continue protecting the premises; and which can be manually activated by the occupants of the premises under a perceived emergency condition.

The present invention comprises an improved alarm control system which overcomes the foregoing and other problems long since associated with the prior art. In accordance with the broader aspects of the invention, a bus line is routed about the interior perimeter of a premises to be protected. A plurality of sensors each positioned near a port of entry to be monitored are connected to the bus line. Each sensor includes line wound on a biased reel and secured at one end to the port of entry. Upon the disturbance of a sensor, circuitry within a master control station connected to the bus line is triggered to activate an external alarm device for a predetermined interval. Following the predetermined alarm interval, the system automatically resets to a ready and armed condition to continue protecting the premises.

In accordance with more specific aspects of the invention, an improved alarm control system incorporating a four conductor bus line leading from a master control station is extended about the interior of a premises. The master control station contains electronic circuitry for energizing the bus line and for activating either an external alarm device or an internal test lamp for a predetermined period of time responsive to warning signals generated by one or more sensors connected in parallel relationship to the bus line. Located near each port of entry to be monitored, each sensor includes a biased supply reel of line which is connected at one end to the port of entry. Movement of any port of entry actuates a magnetically responsive switch within the sensor to transmit a pulse of current triggering timer circuitry within the master control station. Subject to the positioning of a mode switch, either an external alarm or an internal lamp is activated for a preset interval. The system resets automatically after each activation to provide continued protection of the premises without any manual intervention whatsoever.

Preferably, the lines in the sensors are formed of a thermoplastic material, such as nylon monofilament, which would deform under abnormally warm temperature conditions to add a fire detection capability to the system. At least one remote station is connected to the bus line to arm, disarm, or activate the system manually from desired locations within the premises. If desired, a key operated switch can be connected to the system to arm or disarm the system from without the premises.

DESCRIPTION OF THE DRAWINGS

A more complete understanding of the invention can be had by reference to the following Detailed Description when taken in conjunction with the accompanying Drawings, wherein.

DETAILED DESCRIPTION

Figure 1:
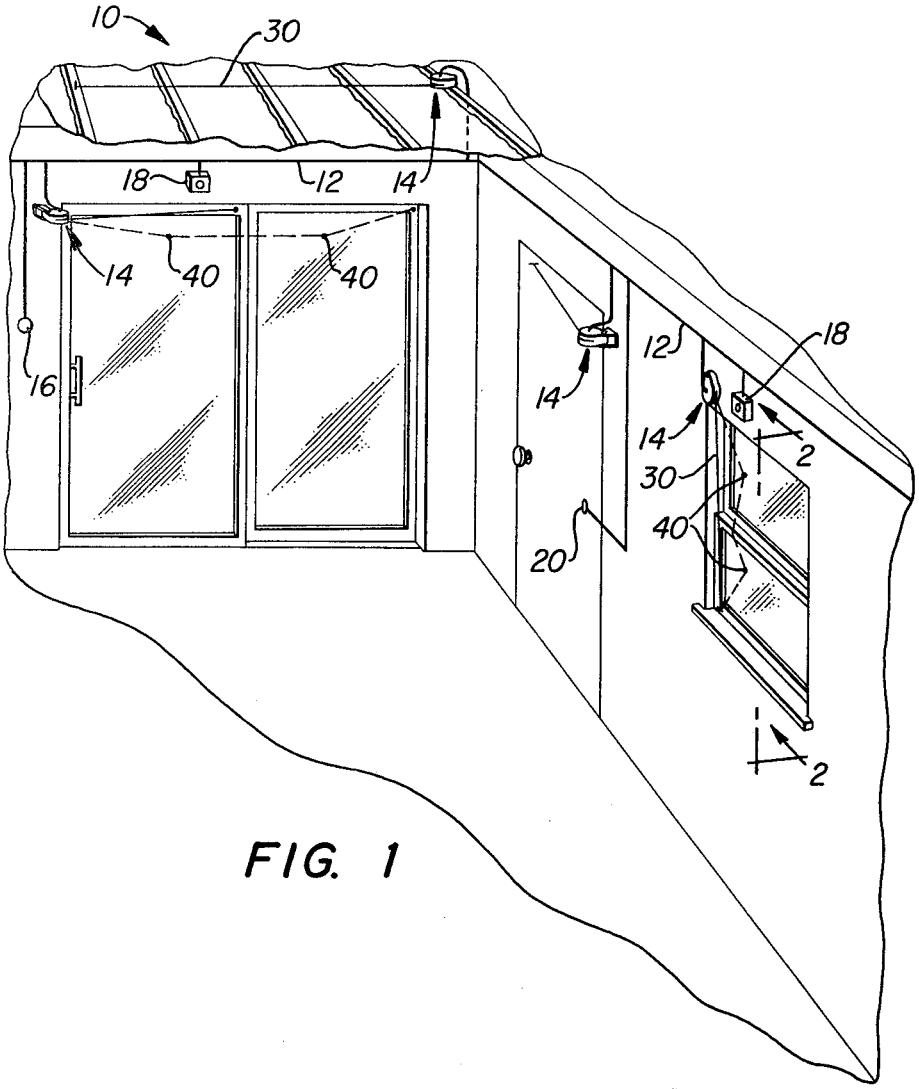
FIG. 1 is an illustration depicting a typical installation of a portion of the alarm control system of the present invention.

Referring now to the Drawings, wherein like reference characters designate like or corresponding parts throughout the several views, and particularly referring to FIG. 1 thereof, there is shown an improved alarm control system 10 incorporating a first embodiment of the invention. Alarm system 10 is uniquely designed for the protection of a premises, such as a house, apartment, office, or any other building having at least one movable port of entry. The invention is of uncomplicated construction and is therefore relatively inexpensive. Alarm control system 10 is suited for easy assembly and installation on either a permanent or semi-permanent basis by an occupant.

In the installation of system 10, a bus line 12 is routed about the interior perimeter of a premises to be protected as illustrated in FIG. 1. A master control station (not shown) is connected at any point along line 12. Sensors 14 located at each port of entry to be monitored are connected along line 12 in parallel fashion. Similarly, at least one remote station 16 is connected to line 12 for selectively arming, disarming or activating alarm system 10. If desired, indicators 18 can also be connected to line 12 for warning the occupant(s) of the premises that alarm system 10 is in the armed or ready condition. In addition, key operated switch 20, mounted for example in a door, can be connected to line 12, if desired, for arming or disarming system 10 from the exterior of the premises. As will be hereinafter described in more detail, disturbance of any sensor 14 triggers circuitry within the master control station to activate an external alarm device or an internal test lamp for a predetermined period of time, after which the system automatically resets or reverts to an armed condition for continued protection of the premises.

Figure 3:
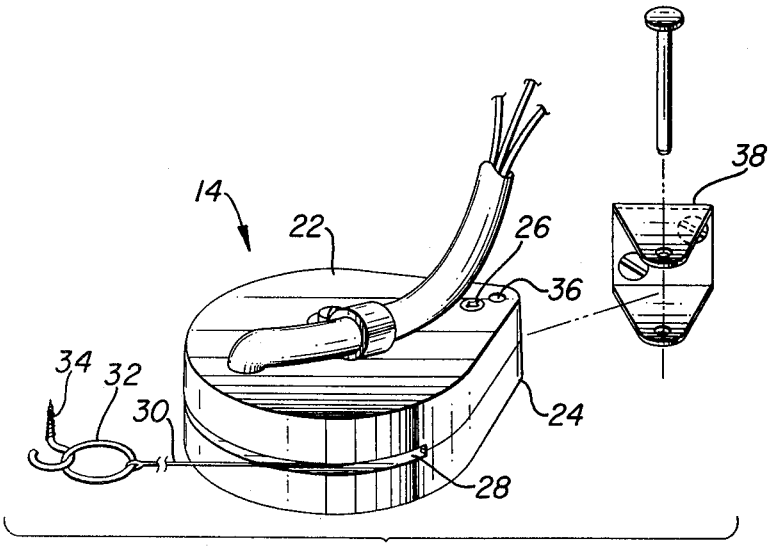
FIG. 3 is an illustration of a sensor and the optional bracket therefor for use in the invention.

In reference to FIG. 3, there is shown a sensor 14, a plurality of which are utilized in system 10. Each sensor 14 includes upper and lower housings 22 and 24 fastened together with screw 26. Each housing 22 and 24 includes a notched portion to form a peripheral slot 28 in sensor 14. Slot 28 extends about a portion of the circumference of sensor 14 and approximately 270 degrees in the preferred embodiment. Slot 28 comprises the guide way through which line 30 is permitted to translate relative to sensor 14. Line 30 is preferably constructed of a thermoplastic material, such as nylon monofilament, which is of low visibility and deforms under high temperatures. Line 30, a quantity of which is stored within each sensor 14, includes a loop or ring 32 at the distal end thereof. By means of line 30 and ring 32, each sensor 14 is directly connected to a port of entry with, for example, a screw hook 34, nail, plain screw, staple, or the like.

Figure 2:
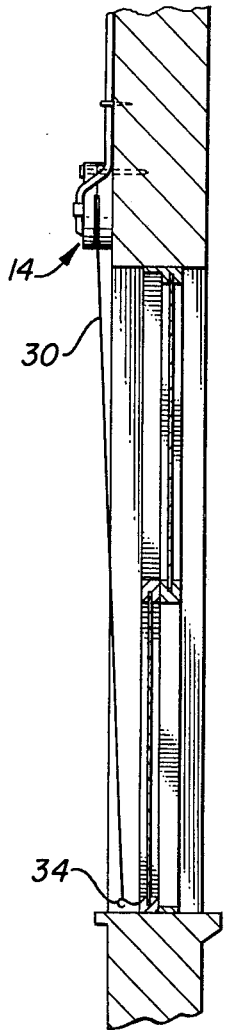
FIG. 2 is a sectional view taken generally along lines 2—2 of FIG. 1 and illustrating connection of a sensor to a window.

Referring momentarily to FIGS. 1 and 2 in conjunction with FIG. 3, a sensor 14 is provided for each port of entry or area to be monitored. Each sensor 14 is anchored through a bore 36 extending through housings 22 and 24. Depending upon the character of movement for the particular port of entry, sensor 14 can be secured with a screw, nail, pin, or the like through bore 36 directly to a wall as shown in FIG. 2, or to a bracket 38 as shown in FIG. 3. Preferably, bracket 38 is utilized for doors, screen doors, sliding patio doors, or other ports of entry openable in a generally horizontal direction. In the case of an area to be monitored for abnormal warmth, a length of line 30 is extended through the area, such as an attic as shown in FIG. 1. As shown in FIG. 2, sensor 14 can be directly anchored through bore 36 to the wall of a premises near a window or other port of entry movable in a generally vertical direction. Line 30 of each sensor 14 is attached directly to the door, screen door or window frame, window sash, or the like to detect movement thereof. In the case of doors or windows having breakable panes therein, lines 30 are preferably strung as shown in phantom lines in FIG. 1 about pegs 40 attached to the window panes. In this manner, breakage or movement of either section of the window or patio door will cause movement of line 30 attached thereto. It will thus be understood that an intrusion or attempted intrusion through a monitored port of entry, or abnormal warmth in a monitored space, is detected by a sensor 14 through line 30.

Figure 4:
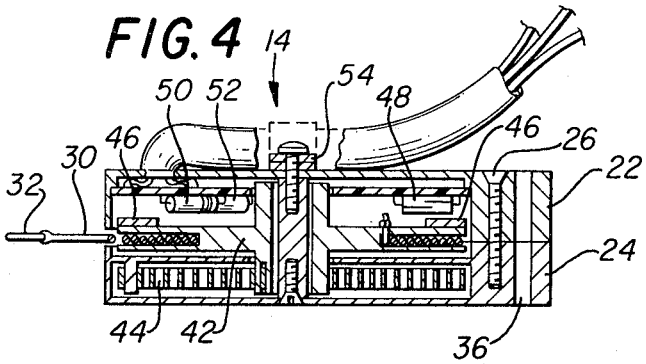
FIG. 4 is a cross-sectional view of the sensor shown in FIG. 3.
Figure 5:
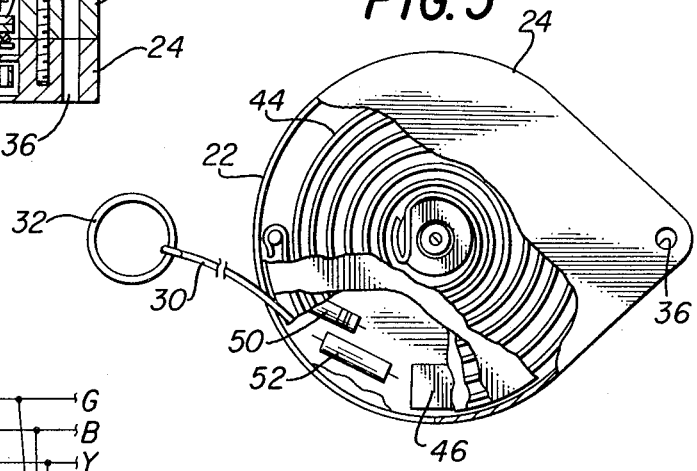
FIG. 5 is a bottom view of the sensor shown in FIG. 3 in which certain parts have been cut away to illustrate more clearly certain features of the invention.
Figure 8:
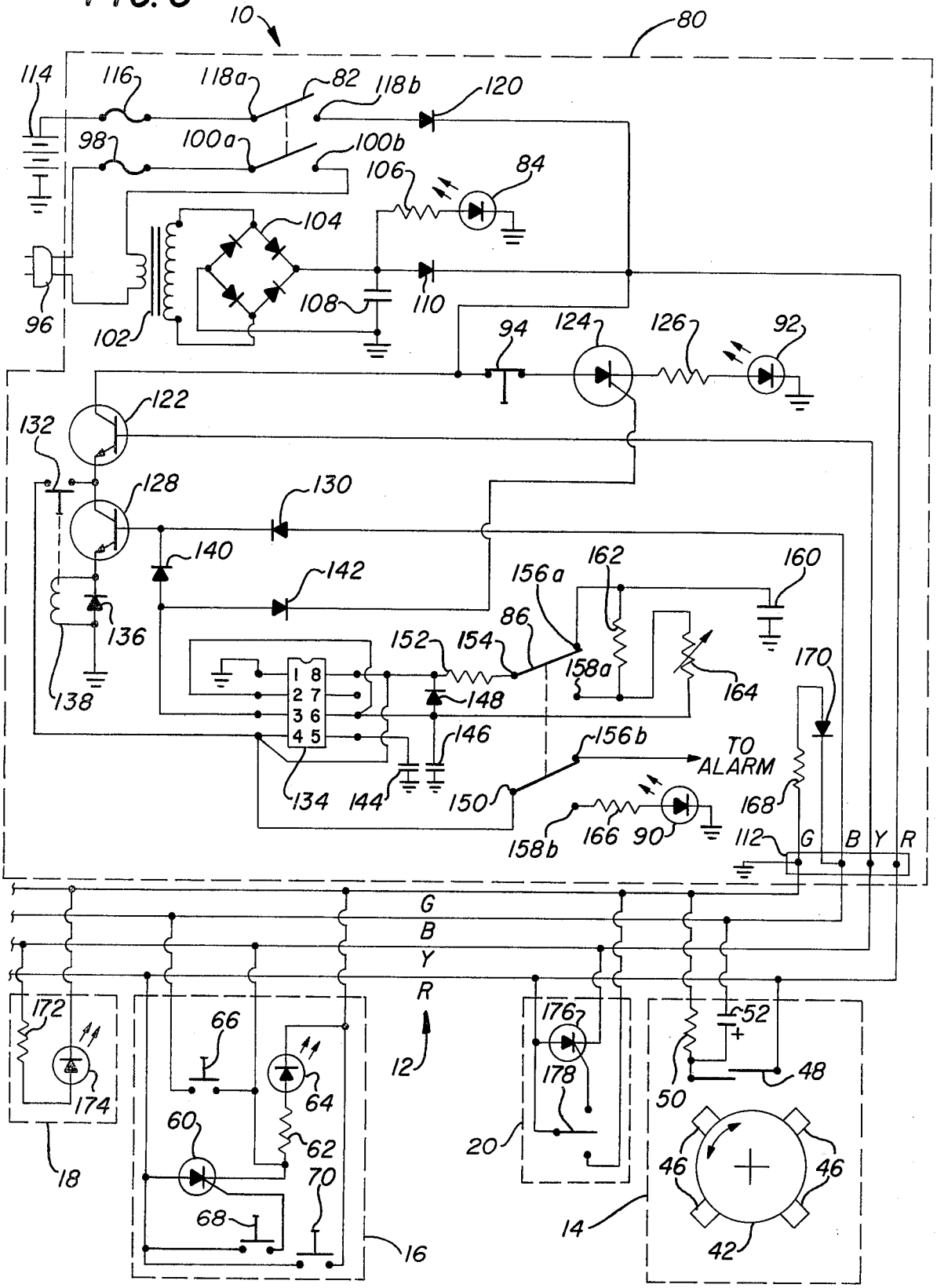
FIG. 8 is a schematic diagram of the electronic circuitry employed in the invention.

Referring now to FIGS. 4 and 5 in conjunction with FIG. 8, there is shown the internal construction details of sensor 14. Line 30 is wound about and secured at one end to reel 42, which is mounted for rotation within sensor 14. Reel 42 is biased by flat coil spring 44 to draw line 30 inward and thus eliminate any slack or play between sensor 14 and the port of entry being monitored. A plurality of small, permanent magnets 46 are secured at equal intervals to reel 42 for rotation therewith. In the preferred embodiment, four magnets 46 are bonded at 90 degree intervals around reel 42. Fixedly mounted within sensor 14 are switch 48, resistor 50 and capacitor 52. In particular, switch 48 is mounted adjacent the path of magnets 46. The wires to sensor 14 for connection with switch 48, resistor 50 and capacitor 52 are preferably fixed with cable clamp 54.

As is best shown in FIG. 8, bus line 12 comprises conductors G, B, Y, and R. If desired, a four conductor cable of the telephone type including red, yellow, black, and green wires can be used. Switch 48 comprises a miniature single pole/single throw (SPST) switch having a first terminal connected to conductor R and a second terminal connected through resistor 50 to conductor G. Capacitor 52 is connected between conductor B and the second terminal of switch 48. It will thus be apparent that switch 48 is a normally open switch which is closed when a magnet 46 passes nearby. Movement of line 30 and thus reel 42 in either direction causes actuation of switch 48. In the preferred embodiment, line 30 comprises a thermoplastic material, such as nylon monofilament line, so that sensors 14 are disturbed by abnormally high temperatures as well as by movement of a monitored port of entry.

Figure 6:
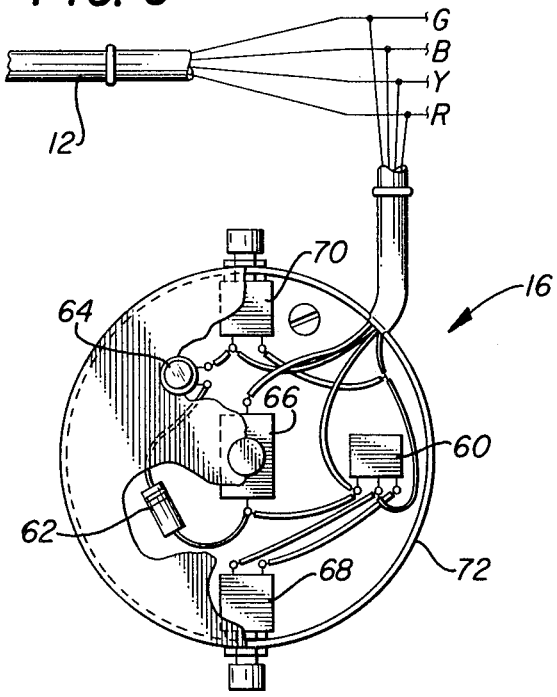
FIG. 6 is an illustration of a remote station incorporated in the invention.

Referring now to FIG. 6 in conjunction with FIG. 8, there is shown remote station 16 at least one of which is employed with alarm system 10. Station 16 can be placed at the desired location(s) within the premises to manually arm, disarm, or activate alarm system 10. Station 16 includes silicon controlled rectifier (SCR) 60, resistor 62, light emitting diode (LED) 64, and switches 66, 68 and 70 mounted within housing 72. As is best shown in FIG. 8, conductor R is connected to the anode of SCR 60. The cathode of SCR 60 is connected to conductor Y, as well as through resistor 62 and LED 64 to conductor G. Normally open single pole/single throw (SPST) switch 66 bridges conductors B and Y. Normally open SPST switch 68 is connected between the gate and anode of SCR 60. Normally open SPST switch 70 is connected between the anode of SCR 60 and conductor G. If desired, a single pole/double throw (SPDT) switch with the center terminal connected to the anode of SCR 60 and the other two terminals connected to the gate of SCR 60 and conductor G, could be utilized in place of switches 68 and 70. Preferably, switches 66, 68 and 70 are of the spring loaded open or pushbutton type. As will be more fully explained hereinafter, switch 66 is provided for the manual activation of alarm system 10 by the occupant(s) of the premises in the event of attack, sudden illness, or other emergency. Switches 68 and 70 are provided for arming and disarming system 10, respectively.

Figure 7:
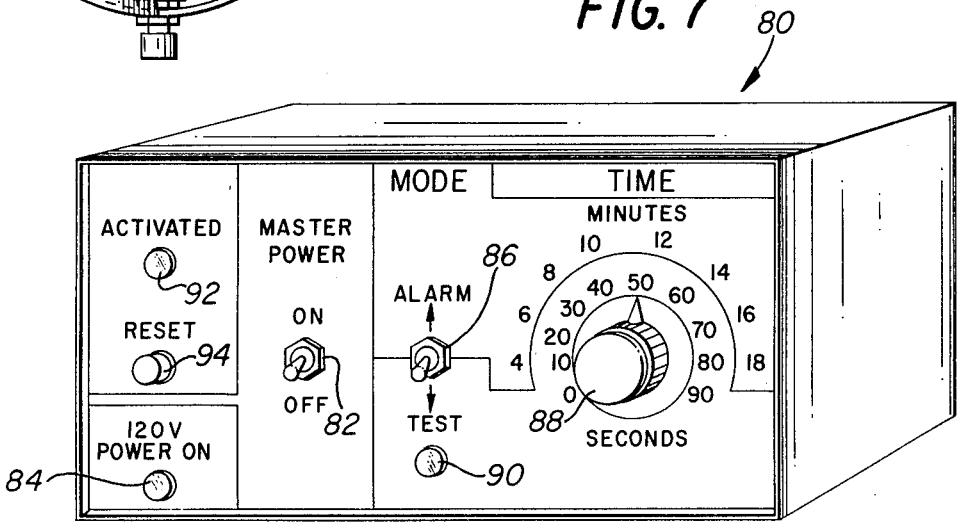
FIG. 7 is a perspective view of the master control station used in the invention.

Turning now to FIG. 7, there is shown master control station 80, one of which is incorporated in alarm system 10. Control station 80 energizes bus line 12 and contains electronic circuitry for controlling an alarm device of the desired type responsive to a disturbance of a sensor 14 connected to line 12. Control station 80 actuates the alarm device or a test lamp for a predetermined period of time, after which system 10 resets automatically to an armed or ready condition. System 10 will repeat this sequence for an indefinite number of cycles without any manual intervention or external assistance whatsoever.

The front panel of control station 80 contains master power switch 82 having ON and OFF positions. Lamp 84 is illuminated when switch 82 is on and 120 volt alternating current is being utilized. The front panel of control station 80 further includes mode switch 86 having ALARM and TEST positions, and knob 88. Two sets of numerals representing units of time are arranged radially about knob 88. When switch 86 is in the alarm position, knob 88 reads on the outer scale of time units, representing minutes in the preferred embodiment. When switch 86 is in the test position, knob 88 reads on the inner scale of time units, representing seconds in the preferred embodiment. Lamp 90 is illuminated for the preset period of time when switch 86 is in the test position and a sensor 14 is disturbed. Lamp 92 illuminates and remains illuminated when system 10 has been activated to serve as a visual warning light. Pushbutton switch 94 is for extinguishing lamp 92.

The circuitry within control station 80 is shown in FIG. 8. One end of a lead extending from plug 96 is connected through fuse 98 to contact 100*a* of double pole/single throw (DPST) switch 82. The end of the other lead extending from plug 96 is connected through the primary winding of transformer 102 to contact 100*b* of switch 82. The secondary winding of transformer 102 is connected to the input terminals of fullwave rectifier 104. One output terminal of rectifier 104 is connected to ground potential. The series combination of resistor 106 and an LED comprising lamp 84 is connected between ground potential and the other output terminal of rectifier 104. Capacitor 108 bridges the output terminals of rectifier 104. For back bias protection, diode 110 is connected between rectifier 104 and terminal R on terminal strip 112, which is mounted on the rear panel of control station 80 in the preferred construction. Plug 96 receives 120 volt ac from a primary source, which transformer 102 converts into approximately 13–15 volt dc to power alarm system 10.

In accordance with the preferred construction, master control station 80 provides for the connection of an auxiliary source of power. Battery 114 is connected through fuse 116 to contact 118*a* of switch 82. A readily available dry cell type battery generating about 12 volts dc can be utilized for battery 114. Contact 118*b* of switch 82 is connected through diode 120 to terminal R on terminal strip 112. Alarm system 10 reverts to battery 114 in the event of a failure in the primary power source. Diode 120 prevents the back bias of current when switch 82 is closed and the primary power source is being utilized. It will thus be understood that a safe level of current, approximately 13–15 volts dc, is employed to power alarm system 10, whether the primary or the auxiliary source of power is used.

The collector of transistor 122 is connected to terminal R of strip 112. The base of transistor 122 is connected to terminal Y of strip 112. The anode of SCR 124 is connected through normally closed, SPST pushbutton switch 94 to terminal R of strip 112. The cathode of SCR 124 is connected through the series combination of resistor 126 and a LED comprising lamp 92 to ground potential.

The emitter of transistor 122 connects to the collector of transistor 128. The base of transistor 128 connects through diode 130 to terminal B on strip 112. Normally open SPST switch 132 connects the emitter of transistor 122 and the collector of transistor 128 with pin 4 of integrated circuit (IC) 134. The emitter of transistor 128 is connected to ground potential through diode 136. Coil 138 is connected across diode 136 and actuates switch 132 to a closed condition when a signal on the base of transistor 128 establishes current flow therethrough.

IC 134 performs a timing function. Any suitable IC can be used. For example, an IC such as Radio Shack No. 555 IC timer having pin contacts 1–8 as shown in FIG. 8 can be utilized. Pin 3 of IC 134 connects through diode 140 to the base of transistor 128. Pin 3 of IC 134 is also connected through diode 142 to the gate of SCR 124. Pin 1 of IC 134 is connected to ground potential. Pins 2 and 6 of IC 134 are wired together. Pins 4 and 8 of IC 134 are also wired together. Pins 5 and 6 are connected through capacitors 144 and 146, respectively, to ground potential. Diode 148 bridges pins 6 and 8 of IC 134. Pin 7 of IC 134 is not used.

Pins 8 and 4 of IC 134 are connected directly to one input contact 150 of double pole/double throw (DPDT) switch 86, and through resistor 152 to the other input contact 154 of switch 86. Switch 86 includes two pairs of output contacts; 156*a* and *b*, and 158*a* and *b*. Capacitor 160 is provided between contact 156*a* and ground potential. Resistor 162 bridges contacts 156*a* and 158*a*. Potentiometer or variable resistor 164, which is controlled by knob 88, interconnects contact 158*a* and pins 6 and 2 of IC 134. Any suitable alarm device, such as a bell, silent alarm, lights, telephone dialing unit, or the like, can be connected to contact 156*b*. The series combination of resistor 166 and LED comprising lamp 90 is connected between contact 158*b* and ground potential.

Finally, terminal G of strip 112 is connected to ground potential and the series combination of resistor 168 and diode 170 interconnects terminals G and B of strip 112.

Shown in FIG. 8 are two accessories which can be incorporated, if desired, to further increase the capabilities of alarm system 10. Indicator 18 comprises resistor 172 and LED 174 connected in series between conductors Y and G of bus line 12. LED 174 is illuminated whenever system 10 is armed and energized. Accordingly, one or more indicators 18 can be connected in parallel fashion to line 12 to serve as reminders to the occupants of the premises that system 10 is operative. If desired, at least one key operated switch 20 can also be connected to line 12 to provide for arming and disarming of system 10 from the exterior of the premises. The anode of SCR 176 is connected to conductor R while the cathode thereof is connected to conductor Y of line 12. The anode of SCR 176 is also connected to the center terminal of normally open SPDT switch 178. The remaining contacts of switch 178 are connected to the gate of SCR 176 and conductor G. Switch 178 is actuated by a key (not shown) and is preferably biased to the middle, normally open position. Utilization of this form of key operated switch is preferred because alarm system 10 can be armed or disarmed from outside the premises, and subsequently disarmed or rearmed from a remote station 16 within the premises. If desired, a simple switch could be substituted for switch 20; however, in that event, system 10 could not be disarmed from a remote station 16.

OPERATION OF THE INVENTION

Improved alarm control system 10 described in the preceding paragraphs operates as follows. To energize system 10, switch 82 is closed to provide current to conductor R in bus line 12. The closing of switch 82 allows current flow to transistor 122, and through switch 94 to SCR 124. Lamp 84 is illuminated when utilizing alternating current through plug 96 to indicate that the power is on.

Alarm control system 10 is then armed or initialized to a ready condition in one of two manners. Actuation of switch 68 in any remote station 16 applies a pulse of current to the gate of SCR 60, establishing current flow therethrough from conductor R into conductor Y. Alternatively, actuation of switch 178 in key operated switch 20 establishes current from conductor R through SCR 176 and into conductor Y. The current in conductor Y is fed to the base of transistor 122 which is thus opened to allow current flow to switch 132 and transistor 128. When alarm system 10 is armed and ready for operation, LED 64 and LED 174 in each station 16 and indicator 18, respectively, are illuminated.

System 10 is activated when switch 66 is closed or when a sensor 14 is disturbed. Rotation of reel 42 by movement of a monitored port of entry, or by breakage or elongation of line 30, causes a magnet 46 to pass by and thus close switch 48. Capacitor 52 charges and transmits a pulse of current into conductor B to the base of transistor 128. Transistor 128 is thus opened to energize coil 138, which closes switch 132 establishing current flow to pins 4 and 8 of IC 134. Current flow from pin 3 of IC 134 is fed to the base of transistor 128 so that coil 138 is kept energized and switch 132 is maintained closed until termination of the timing cycle.

Even if a magnet 46 should stop next to switch 48 holding it closed, it will be understood that only one pulse of current is released due to the charging characteristics of a capacitor. Resistor 50, provided between the positive pole of capacitor 52 and ground potential, dissipates any charge buildup beyond that formed to transmit a single pulse for each closure of switch 48.

The current flow to IC 134 is then directed to switch 86. If mode switch 86 is in the alarm position as shown in FIG. 8, the alarm device is activated and a signal is fed through resistors 152, 162 and 164 back to pins 6 and 2 of IC 134. The alarm interval is determined by the values of capacitors 144, 146, resistors 152 and 162, as well as the preselected setting of resistor 164. If mode switch 86 is in the test position, resistor 162 is bypassed and lamp 90 is illuminated for a relatively shorter period of time.

Following the timing cycle, current from IC 134 to the base of transistor 128 is withdrawn deenergizing coil 138. Consequently, switch 132 opens to deactivate either lamp 90 or the alarm. System 10 is thus reset automatically. It will be appreciated that lamp 92 remains illuminated after the first activation of system 10 opens SCR 124. Momentarily opening switch 94, of course, extinguishes lamp 92. Any subsequent disturbances of a sensor 14 or closings of any switch 66 will, of course, reactivate system 10.

Alarm control system 10 can be disarmed at any remote station 16 or key operated switch 20. Actuation of either switch 70 or switch 178 shorts any active SCR 60 or SCR 176 to ground potential to break the flow of current between conductors R and Y. Opening switch 82 would also effectively disarm system 10.

In view of the foregoing, it will be understood that the present invention comprises an improved alarm control system which incorporates numerous advantages over the prior art. One significant advantage of the present invention involves the automatic reset feature by which the system is returned to an armed or ready condition a predetermined period of time after each activation to continue sensing alarm conditions on the premises. No manual intervention whatsoever is required after energizing and arming the system. Other important advantages stem from the particular construction of the sensors. Movement of a monitored port of entry in either direction from each preceding position is sensed, and the use of a thermoplastic line gives the system a fire detection capability. In addition, there is the advantage of being able to manually activate the alarm device under emergency conditions. Other advantages attending the use of the invention will readily suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements or substitutions of parts and elements as fall within the spirit and scope of the invention.

What is claimed is:

1. In a premises having at least one port of entry, an improved alarm control system for activating an alarm device comprising:

a master control station;

a bus line originating from said master control station and having a first conductor, a second conductor and a third conductor, said first conductor energizing said second conductor when the system is armed;

at least one sensor means connected to said bus line, each for sensing an alarm condition and transmitting an alarm signal through said bus line by momentarily energizing said third conductor;

said master control station comprising first means actuated upon energization of said first and second conductors, second means actuated upon actuation of said first means and energization of said third conductor, switch means actuated upon actuation of said second means in response to the transmitted alarm signal for activating the alarm device and timer means responsive to actuation of the switch means for deactuating said second means and said switch means to deactivate the alarm device and thereby reinitialize the entire system after an adjustable, predetermined time interval established by the timer means following each actuation of said switch means.

2. The improved alarm control system of claim 1 wherein each of said sensor means comprises:

a biased reel mounted for rotation;

a supply of line carried on said reel and connected to a port of entry to be monitored; and means responsive to rotation of the reel by movement of the line for generating a single pulse of current signalling an alarm condition through said third conductor.

3. The improved alarm control system according to claim 2 wherein the line comprises a thermoplastic material deformable under abnormally warm temperature to effect rotation of said reel so that a pulse of current is generated signalling a fire alarm condition.

4. The improved alarm control system of claim 1 including lamp means illuminated in response to the first actuation of the switch means for indicating that the alarm device has been activated said lamp means remaining illuminated after deactuation of said switch means.

5. The improved alarm control system of claim 1 including manual switch means for activating the alarm device in response to a perceived emergency condition.

6. The improved alarm control system of claim 1 including means connected to said bus line connected to said timer means for selectively adjusting the predetermined time interval established by said timer means.

7. The improved alarm control system of claim 1 further including:

test lamp means; and mode switch means for selectively disconnecting the alarm device and connecting said test lamp means to said timer means and said switch means for illumination during a second adjustable, predetermined time interval permitting a test of said alarm control system to be of different duration than said alarm device activation interval.

8. In an alarm control system including means for sensing movement of monitored ports of entry to a premises, and switch means responsive to the disturbance of sensing means for connecting an alarm device with a source of power to thereby activate said alarm device, the improvement comprising:

a master control station having a bus line originating from said station, said bus line comprising first, second and third conductors, said first conductor being connected to a source of power and said second conductor being connected to the power source through said first conductor to initialize the alarm control system, said sensing means being connected to said bus line, the disturbance of said sensing means causing said third conductor to be connected to a source of power;

said master control station comprising first actuation means actuated by connecting said first and second conductors to a source of power, second actuation means actuated by the actuation of said first actuation means and by connecting said third conductor to a source of power, the switch means being actuated by the actuation of said second actuation means, timer means responsive to actuation of the switch means for establishing an adjustable, preselected time interval for activation of the alarm device and for deactuating said second actuation means and the switch means to deactivate the alarm device and thereby reset the entire system following expiration of said time interval, and means connected to said timer means for selectively adjusting the time interval established thereby;

said sensing means being connected to said bus line and including:

a biased reel mounted for rotation;

a supply of line carried on said reel and connected to a port of entry to be monitored; and means responsive to rotation of the reel by the line for generating a single pulse of current to signal an alarm condition through said third conductor.

9. An improved alarm control system for activating an alarm device upon the detected breach of any port of entry to a premises, which comprises:

a master control station;

a bus line originating from said master control station and comprising first, second, third and fourth conductors, said first conductor being connected to a source of power and said fourth conductor being grounded;

at least one sensor means connected to said bus line, each for sensing an alarm condition;

at least one first switch means for manually initializing the system by connecting said second conductor to said first conductor;

each of said sensor means including a biased reel mounted for rotation, a supply of line carried on said reel and interconnecting said reel to the corresponding port of entry to be monitored, and means responsive to rotation of the reel for transmitting a single pulse of current representing an alarm signal through said third conductor; and said master control station comprising:

first actuation means actuated by connecting said first and second conductors to a source of power;

second actuation means actuated by the actuation of said first actuation means and current transmitted through said third conductor;

second switch means actuated in response to the actuation of said second actuation means for activating the alarm device;

timer means responsive to actuation of the second switch means for establishing an adjustable, preselected time interval for activation of the alarm device and for deactuating said second actuation means and said second switch means to deactivate the alarm device and thus reset the entire system following the expiration of said time interval; and means connected to the timer means for selectively adjusting the predetermined time interval established by said timer means.

10. The improved alarm control system of claim 9 including lamp means illuminated in response to the first activation of the alarm device for indicating that the device has been activated said lamp means remaining illuminated after deactivation of said alarm device.

11. The improved alarm control system of claim 9 including manual switch means connected to said bus line for activating the alarm device in response to a perceived emergency condition.

12. The improved alarm control system of claim 9 further including:

test lamp means; and mode switch means for selectively connecting said test lamp means to the timer means and the second switch means and disconnecting the alarm device so that said test lamp means is illuminated a second adjustable, preselected time interval established by the timer means permitting a test of said alarm control system to be of different duration than said alarm device activation interval.

13. An improved alarm control system for protecting a premises by activating an alarm device upon detection of an alarm condition, which comprises:

a master control station;

a bus line including first, second, third, and fourth conductors installed about the perimeter of the premises and originating from said master control station;

said first conductor being connected to a suitable source of current from said master control station and said fourth conductor being connected to ground potential;

said master control station comprising a first transistor having a collector connected to said source of current and the first conductor, a base having said second conductor connected thereto, and an emitter, a second transistor having a collector connected to the emitter of the first transistor, a base having said third conductor connected thereto, and an emitter;

at least one manual switch means connected to said bus line for selectively connecting the first and second conductors to initialize and arm the system for detection of alarm conditions;

at least one sensor means connected to the bus line and responsive to movement of the corresponding monitored port of entry for transmitting with each disturbance thereof a pulse to the base of the second transistor to momentarily open said transistor;

said master control station further comprising switch means responsive to current flow through the second transistor for activating the alarm device and timer means connected between the switch means and the second transistor for applying the current to the base of said second transistor for an adjustable, preselected period of time during which said second transistor is maintained open with the alarm device activated, and after which time period current is removed from said second transistor to deactivate the alarm device and reset the entire system for detection of subsequent alarm conditions.

14. The alarm control system of claim 13 wherein said station further comprising a primary source of power including:

a transformer having a primary winding connectable to a source of alternating current, and a secondary winding; and rectifier means having pairs of input and output terminals, said input terminals being connected to the secondary winding of the transformer and one of said output terminals being connected to the first conductor.

15. The alarm control system according to claim 14 including lamp means connected to one of said output terminals of said rectifier means for indicating that the first conductor is energized.

16. The alarm control system according to claim 14 further including an auxiliary source of power comprising a battery connectable to said first conductor.

17. The alarm control system of claim 13 further including lamp means responsive to the first activation of the alarm device for indicating that the alarm device has been activated said lamp means remaining illuminated after deactivation of said alarm device.

18. The alarm control system according to claim 17 further including switch means for selectively extinguishing said lamp means.

19. The alarm control system of claim 13 wherein each of said sensor means comprises:

A biased reel mounted for rotation;

a supply of line carried on said reel and secured to a port of entry to be monitored to the premises;

a plurality of magnets secured at predetermined intervals to said reel for rotation therewith; and magnetic switch means for selectively connecting the first and third conductors responsive to movement of the magnets on said reel for generating a single pulse of current through said third conductor signaling an alarm condition.

20. The alarm control system according to claim 19 wherein said magnetic switch means comprises:

a reed switch having two contacts, with one of said contacts connected to the first conductor;

capacitance means connected between the other contact of said reed switch and the third conductor for charging and transmitting said pulse of current through said third conductor when the reed switch is closed; and resistance means connected between ground potential and the other contact of said reed switch for dissipating any secondary charge build up on the capacitance means.

21. The alarm control system according to claim 19 wherein the line comprises a thermoplastic material deformable under abnormally warm temperatures to disturb the sensor means and thus signal a fire alarm condition.

22. The alarm control system of claim 13 further including lamp means connected to said bus line between the second conductor and ground potential for signaling that the alarm system is initialized.

23. The alarm control system of claim 13 wherein each of the manual switch means connected to said bus line comprises:

a silicon controlled rectifier having an anode connected to the first conductor, a cathode connected to the second conductor, and a gate;

switch means connected between the anode and the gate of said silicon controlled rectifier for establishing current flow through said rectifier, thereby arming the alarm system; and switch means connected between the anode of the silicon controlled rectifier and ground potential for deestablishing current flow through said rectifier in each of the manual switch means, thereby disarming the alarm system.

24. The alarm control system according to claim 23 further including lamp means connected between the cathode of said silicon controlled rectifier and ground potential for indicating that the system is initialized.

25. The alarm control system according to claim 23 wherein both of said switch means are adapted to be actuated by a key from the exterior of the premises.

26. The alarm control system of claim 23 further including emergency switch means for selectively connecting the second and third conductors and thus activating the alarm device under a perceived emergency condition.

* * * * *

UNITED STATES PATENT AND TRADEMARK OFFICE

CERTIFICATE OF CORRECTION

PATENT NO. : 4,271,405

DATED : June 2, 1981

INVENTOR(S) : LAWRENCE P. KITTERMAN

It is certified that error appears in the above-identified patent and that said Letters Patent are hereby corrected as shown below:

Column 8, line 67, after "means", insert --connected to said bus line--;

Column 9, line 2, after "means", delete "connected to said bus line--.

Signed and Sealed this

*Sixth* Day of *October 1981*

[SEAL]

*Attest:*

GERALD J. MOSSINGHOFF

*Attesting Officer* *Commissioner of Patents and Trademarks*